US006095961A

United States Patent [19]

Mueller et al.

[11] Patent Number: 6,095,961

[45] Date of Patent: Aug. 1, 2000

[54] RADIAL ALIGNER AND FOLDING MECHANISM

[75] Inventors: Henry J. Mueller; Eliot S. Smithe, both of Duncansville, Pa.

[73] Assignee: F. L. Smithe Machine Company, Inc., Duncansville, Pa.

[21] Appl. No.: 09/078,772

[22] Filed: May 14, 1998

[51] Int. Cl.[7] ..... B31B 1/56

[52] U.S. Cl. ..... 493/245; 493/14

[58] Field of Search ..... 493/245, 254, 493/260, 432, 424, 417, 418, 443, 442, 450, 453, 454; 271/272, 270

[56] References Cited

U.S. PATENT DOCUMENTS

| | | | |
|---|---|---|---|
| 1,807,866 | 6/1931 | Novick . | |
| 1,860,984 | 5/1932 | Bodge . | |
| 3,108,800 | 10/1963 | Walsh | 271/53 |
| 3,153,533 | 10/1964 | Novick | 271/2 |
| 3,190,644 | 6/1965 | Schwebel | 271/46 |
| 3,316,819 | 5/1967 | Cohn | 93/62 |
| 3,379,432 | 4/1968 | Rüth | 271/2 |
| 3,427,017 | 2/1969 | Cohn | 271/2 |
| 3,474,712 | 10/1969 | Pino et al. | 93/62 |
| 3,641,883 | 2/1972 | Smithe et al. | 93/62 |
| 3,646,858 | 3/1972 | Helm | 93/62 |
| 3,745,894 | 7/1973 | Helm | 93/61 |
| 3,870,293 | 3/1975 | Simeth | 271/231 |
| 4,036,487 | 7/1977 | Heimlicher et al. | 270/71 |
| 4,179,111 | 12/1979 | Gunther, Jr. et al. | 270/68 |
| 4,213,604 | 7/1980 | Sato | 271/233 |
| 4,273,324 | 6/1981 | Philipp | 271/183 |
| 4,341,299 | 7/1982 | Walker et al. | 198/434 |
| 4,355,800 | 10/1982 | Sugiyama | 271/229 |
| 4,504,259 | 3/1985 | Lindenmüller | 493/23 |
| 5,049,120 | 9/1991 | Prüm | 493/342 |

FOREIGN PATENT DOCUMENTS 196 09 991 A1 9/1997 Germany .

*Primary Examiner*—Joseph J. Hail, III
*Assistant Examiner*—Dermott J. Cooke
*Attorney, Agent, or Firm*—Price & Adams

[57] ABSTRACT

A series of overlapping envelope blanks are fed into contact with a pull-out roll which engages and accelerates the first blank to separate it from the remaining blanks. From the pull-out roll, the separated blank is fed onto the surface of a rotary aligning wheel. A plurality of aligning pins extend from the surface of the wheel and are positioned in spaced relation around the wheel. The separated blank is fed into contact with the aligning pins forcing the blank with its trailing edge engaged with the pull-out segment to maintain the separated blank aligned on the surface of the wheel. Vacuum ports are positioned on the surface of the wheel adjacent to the aligning pins. The negative pressure from the vacuum ports secures the sheet to the surface of the wheel as the sheet is aligned into a preselected position on the wheel by contact with the pins. The wheel rotates at a lower speed than the pull-out segment and conveys the separated blanks in a radial path to a point on the aligning wheel where each blank is transferred to a folding mechanism where the seal flap of the blank is folded.

20 Claims, 8 Drawing Sheets

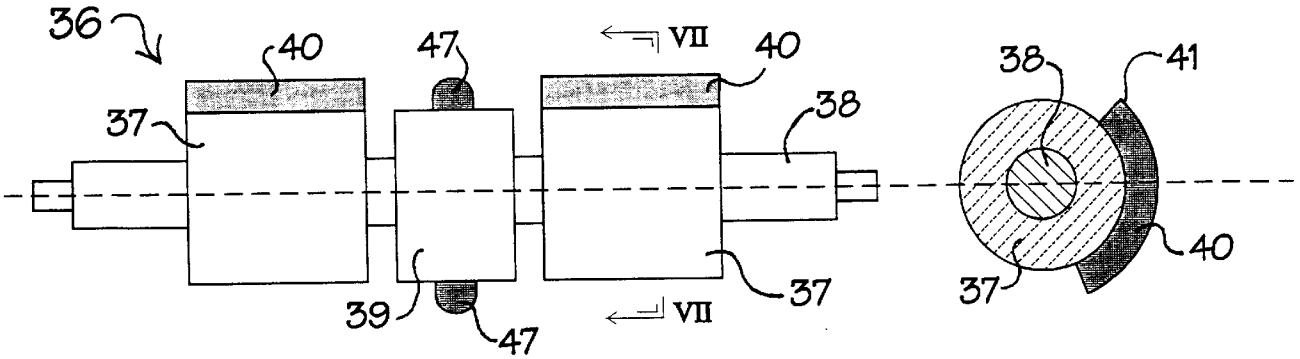
Figure 6
Figure 7
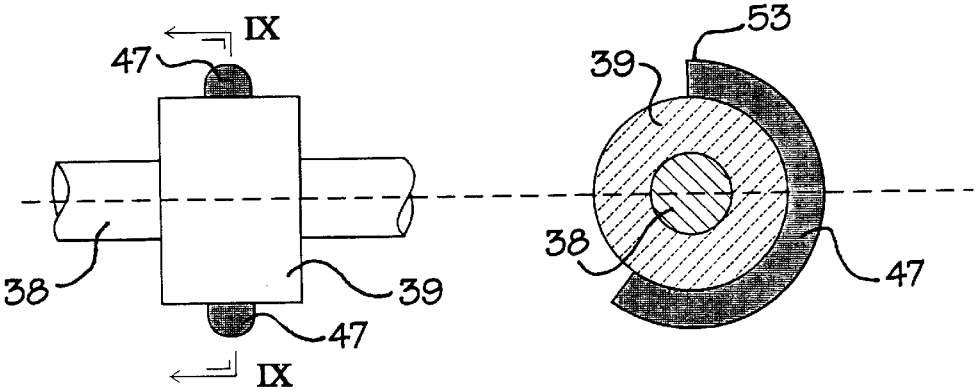
Figure 8
Figure 9

RADIAL ALIGNER AND FOLDING MECHANISM

BACKGROUND OF THE INVENTION

1. Field of the Invention

This invention relates to method and apparatus for aligning blanks of sheet material and, more particularly, to method and apparatus for separating overlapped banks into spaced relation, aligning the blanks, and folding the blanks with a plurality of rotary cylinders.

2. Description of the Prior Art

It is well known in the prior art of envelope manufacturing to align envelope blanks into preselected positions. Proper alignment of the blanks upon conveyance to subsequent envelope forming components is essential to ensure the proper formation of the finished envelope. Traditionally, it is known to accelerate envelope blanks onto a conveyor or table. While on the conveyor, a series of aligning pins or fingers engage portions of the envelope blank and align the blanks into proper position for folding and other subsequent operations.

U.S. Pat. No. 1,807,866 discloses an envelope blank aligning device in which overlapped blanks are separated into spaced relation and placed on a moving conveyor. As the conveyor moves, cut-out portions in the blank engage fingers extending rigidly up out of the conveyor. The motion of the blank against these fingers aligns the blank into the proper position. At this point the fingers are retracted, and the blank is permitted to advance to the next station.

In U.S. Pat. No. 3,153,533, overlapped blanks are separated into spaced relation by a pull-out segment. The pull-out segment grabs the leading blank and accelerates it from the remaining overlapped blanks onto a conveyor. Aligning pins mounted onto aligning chains move at a speed slightly greater than that of the conveyor. The aligning pins engage rear cut-out portions of the envelope blank and align the blank in the proper position for folding and other subsequent operations.

U.S. Pat. No. 3,646,858 discloses an apparatus for aligning envelope blanks similar to that disclosed in U.S. Pat. No. 3,153,533 in which an envelope blank traveling on a aligner table is aligned by pins extending from aligner chains traveling around the table.

In U.S. Pat. No. 3,870,293, an overlapped blank is advanced to engage a series of alignment guides. These guides align the leading edge of the foremost sheet prior to transfer of the sheet. After the sheets have been aligned, a head connected to a cam reciprocally lifts the rear portion of the first sheet and simultaneously blows air under the sheet. This action lifts the leading edge of the first sheet into engagement with an adjacent transfer cylinder. Subsequent sheets are refrained from movement by a suction force also applied by the head.

U.S. Pat. No. 4,341,299 discloses an apparatus for aligning stacks of sheet material. A pair of pushing elements advance the stack along a table, aligning the rear portion of the stack. At a point on the table, the leading edge of the stack abuts a resilient finger projecting above the table surface, aligning the leading edge of the stack. Alternatively, an additional pusher plate may be positioned adjacent the trailing edge of the stack to further ensure proper alignment of the stack.

U.S. Pat. No. 3,108,800 discloses a sheet aligning apparatus in which individual sheets are fed from a stack between opposing feed rolls. The information contained on the sheet is read by a scanner; therefore, the advancement of the sheet must be halted for a period of time to allow the information to be read. The stoppage is provided by a channel parallel to the leading edge of the sheet located at a proper position for scanning the information. As the sheet advances under the scanner, the leading edge abuts the channel and a vacuum port located in the channel engages the leading edge of the sheet to contain the sheet in alignment until such time as the sheet has been scanned. At this point, the vacuum pressure is removed and the sheet is permitted to travel forward.

It is also known in the art to deviate from the above-described flat alignment devices. In U.S. Pat. No. 3,379,432, a rotating cylinder is utilized as the aligning surface. Utilizing a cylindrical surface as the aligning surface substantially reduces the linear space required to align the blanks, particularly for longer length blanks. Envelope blanks are accelerated onto the surface of the cylinder and maintained in contact therewith by a set of outer guides. These guides have frictional surfaces and brushes which slow the blank down to a speed less than that of the cylinder. Adjustable pins extend from the cylinder. As the cylinder rotates, the pins converge onto both the leading and trailing edges of the blank thereby aligning it into a preselected position. The aligned blank is then ejected from the aligning cylinder to an adjacent folding machine.

It is well known in the art of envelope making to utilize special devices to fold the blanks in the proper locations. These folding machines are well known in the art of envelope manufacturing and several examples are disclosed in U.S. Pat. Nos. 1,860,984; 3,316,819; 3,474,712; 3,641,883; 3,745,894; 4,036,487; 4,179,111; 4,504,259; and 5,049,120.

Several alternative sheet aligning methods have also been attempted for various purposes. Several of these methods and devices are disclosed and illustrated in U.S. Pat. Nos. 3,190,644; 3,427,017; 4,273,324; and 4,355,800.

The above-discussed aligning devices have several drawbacks. First, the flat conveyor-style aligner surfaces take up a substantial amount of space. Often, in large high speed envelope making machines linear space is limited. Therefore any device which saves space is beneficial to the machine.

In the case of a rotary aligner, the known apparatus has many moveable and adjustable parts which serve to complicate the device. Complex machinery tends to require increased maintenance demands and often results in decreased reliability. This, in turn, increases the downtime of the machine and therefore decreases its efficiency.

Therefore, there is a need for a sheet material aligning device that efficiently and accurately separates overlapped sheets into properly aligned, spaced sheets in a radial feed path and particularly in a seal flap folding device of an envelope making machine.

SUMMARY OF THE INVENTION

In accordance with the present invention there is provided apparatus for separating and aligning overlapped blanks of sheet material that includes a conveying mechanism supported in a frame member for moving a plurality of overlapped blanks in a feed path at a preselected speed. A feed cylinder is rotatably supported in the feed path adjacent to the conveying mechanism. The feed cylinder includes a pull-out segment. The feed cylinder rotates at a speed greater than the speed of the conveyor mechanism to separate the overlapped blanks into spaced relation. A back-up roller is rotatably supported oppositely of the pull-out segment forming a bight therebetween. A drive mechanism rotates the feed cylinder to advance a first blank in the feed path from the conveyor mechanism into the bight between the pull-out segment and the back-up roller to separate the first blank from the remaining overlapped blanks. An aligner wheel is rotatably supported adjacent to the feed cylinder for receiving the first blank separated from the remaining overlapped blanks. The aligner wheel rotates at a speed slower than the speed of the feed cylinder. The rotary aligner wheel has a plurality of aligning pins extending from the surface of the aligner wheel. The aligning pins receive the first separated blank in abutting relation to align the blank on the aligner wheel. Vacuum devices mounted on the aligner wheel engage separated blanks on the surface of the aligner wheel. The vacuum devices are positioned adjacent to the aligning pins to engage a portion of the first blank as the blank is separated from the remaining overlapped blanks and urged by the pull-out segment into contact with the aligning pins to position the blank on the surface of the aligner wheel for increased engagement of the blank on the surface of the aligner wheel.

Further in accordance with the present invention there is provided apparatus for aligning and folding a blank of sheet material that includes an aligner wheel rotatably mounted in a frame member. A first drive mechanism rotates the aligner wheel in a preselected direction at a preselected speed. The aligner wheel includes a plurality of aligner pins extending from the surface thereof. A device is provided for advancing a blank having a preformed score line at a trailing end thereof into abutting relation with the aligner pins at a speed greater than the speed of the aligner wheel so that a portion of the blank contacts the surface of the aligner wheel. The aligner wheel includes a vacuum mechanism mounted on the surface of the aligner wheel for engaging immediately adjacent the aligner pins the portion of the blank in contact with the aligner wheel to secure the blank to the surface of the aligner wheel in preselected alignment thereon. A second drive mechanism rotates the aligner wheel to advance the blank in a radial feed path. A device positioned adjacent to the aligner wheel receives the blank conveyed in the radial feed path and folds the blank at the preformed score line.

Further in accordance with the present invention there is provided a method for aligning and folding blanks of sheet material that includes the step of feeding a plurality of blanks in overlapping relation with a first blank having a leading edge. The leading edge of the first blank is fed into a nip formed between a rotating pull-out roller and a backup roller. The pull-out roller is rotated at a preselected speed to advance the first blank out of overlapping relation with the remaining blanks. A rotatable aligning wheel is positioned adjacent to the backup roller. A plurality of aligning pins are positioned on the surface of the aligning wheel. A plurality of vacuum ports are positioned on the surface of the aligning wheel for generating negative pressure at the surface adjacent to the aligning pins. The aligning wheel is rotated at a preselected speed slower than the rotational speed of the pull-out roller. The leading edge of the first blank abuts the aligning pins to move the first blank into a preselected position on the surface of the aligning wheel. The first blank upon contact with the aligning pins moves into contact with the surface of the aligning wheel. The portion of the first blank in contact with the surface of the aligning wheel is secured to the surface of the aligning wheel by the negative pressure from the vacuum ports. The aligning wheel is rotated to feed the first blank along a radial feed path. The first blank is removed from the aligning wheel and folded in a feed path removed from the aligning wheel.

Further in accordance with the present invention there is provided apparatus for separating and aligning overlapped blanks of sheet material including conveying means supported in a frame member for moving a plurality of overlapped blanks in a feed path at a preselected speed. A feed cylinder is rotatably supported in the feed path adjacent to the conveying means. The feed cylinder includes a pull-out segment. The feed cylinder is rotated at a speed greater than the speed of the conveying means to separate the overlapped blanks into spaced relation. A backup roller is rotatably supported oppositely of the pull-out segment forming a bight therebetween. Drive means is provided for rotating the feed cylinder to advance a first blank in the feed path from the conveying means into the bight between the pull-out segment and the back-up roller to separate the first blank from the remaining overlapped blanks. An aligner wheel is rotatably supported adjacent to the feed cylinder for receiving the first separated blank from the remaining overlapped blanks. The aligner wheel is rotated at a speed slower that the speed of the feed cylinder. A plurality of belts having outer surfaces are reeved about the aligner wheel and are rotated at a speed slightly faster than said speed of the aligner wheel. The outer surfaces of the belts extend slightly beyond the surface of the aligner wheel. The aligner wheel has a plurality of aligning pins extending from the surface thereof beyond the outer surfaces of the belts. The aligning pins receive in abutting relation the first separated blank to align the blank on the surface of the aligner wheel. The first separated blank is conveyed along the belts and is urged against the slower moving aligning pins into an aligned position. Vacuum means are mounted on the aligner wheel for engaging separated blanks on the surface of the aligner wheel. The vacuum means are positioned adjacent to the aligning pins to engage a portion of the first blank after the blank is aligned against the aligning pins for increased engagement of the blank on the surface of the aligner wheel.

Accordingly, a principal object of the present invention is to provide method and apparatus for separating overlapping blanks of sheet material and aligning the separated blanks as they are fed in a radial feed path.

An additional object of the present invention is to provide a device for aligning a stream of envelope blanks in a radial feed path and conveying the aligned blanks to a folding device where the blanks are folded in an envelope manufacturing process.

These and other objects of the present invention will be more completely disclosed and described in the following specification, the accompanying drawings, and the appended claims.

BRIEF DESCRIPTION OF THE DRAWINGS

FIG. 6 is a top plan view of a segment roller apparatus of the present invention, illustrating the various rollers used to separate blanks from an overlapped relation to a spaced relation.

FIG. 7 is a sectional view in side elevation of a pull-out segment roller taken along the line VII—VII in FIG. 6, illustrating the pull-out segment.

FIG. 8 is a top plan view of a release segment roller of the present invention.

FIG. 9 is a sectional view in side elevation of the release segment roller taken along the line IX—IX in FIG. 8.

DESCRIPTION OF THE PREFERRED EMBODIMENTS

The present invention is employed with apparatus similar to that illustrated in U.S. Pat. Nos. 3,008,382 and 3,116,668. The construction of the vacuum rolls, the folding rolls and the other apparatus for aligning envelopes and folding closure flaps, as well as, the manner in which the apparatus is mounted in the envelope machine frame is well known in the prior art and will not be repeated herein. The present invention is described as it relates to apparatus disclosed in the above enumerated patents, and for this purpose the above enumerated patents are incorporated herein by reference.

Figure 1:
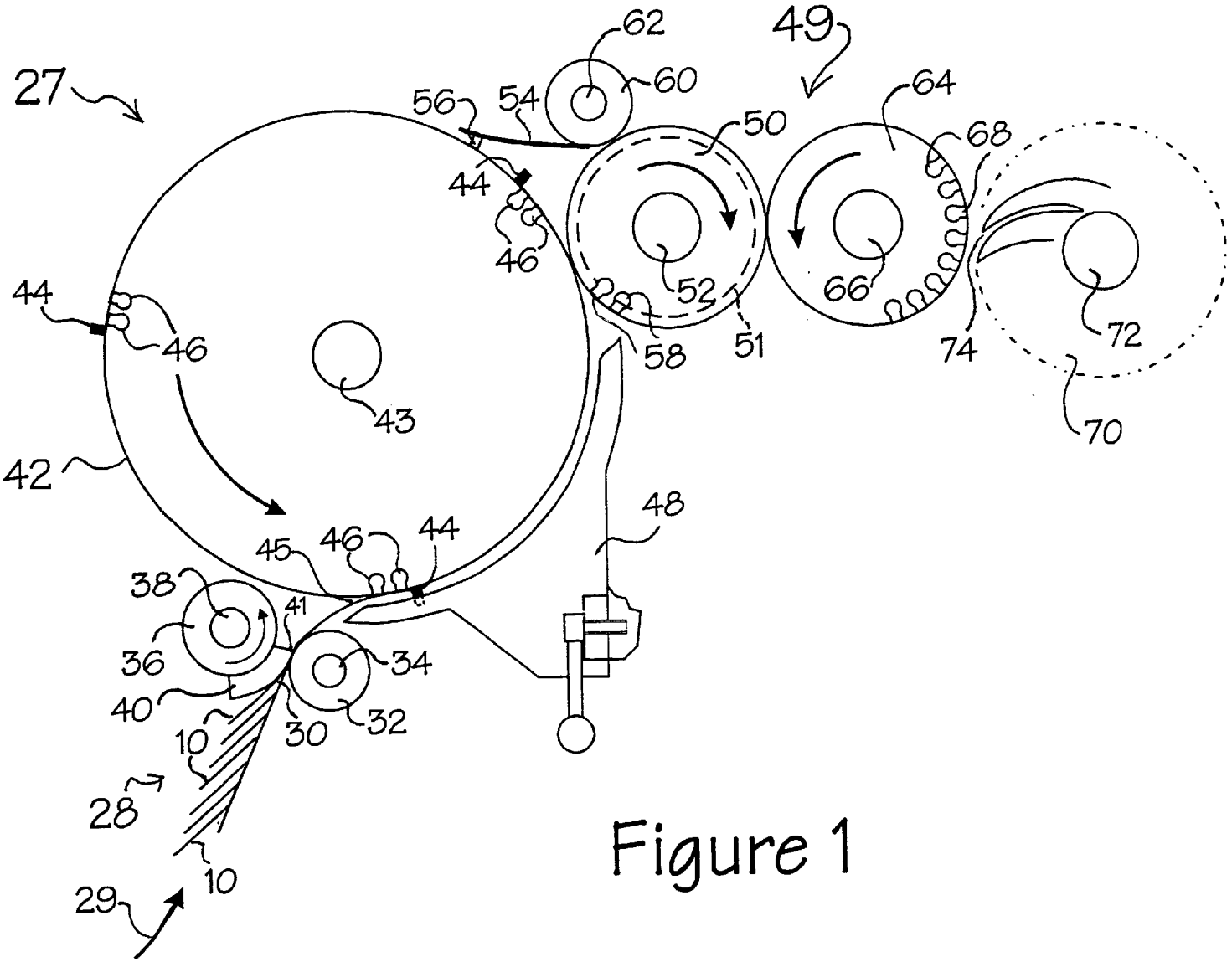
FIG. 1 is a schematic elevational view of a portion of an envelope making machine, illustrating apparatus for aligning and folding envelope blanks fed counterclockwise in a radial feed path.
Figure 5:
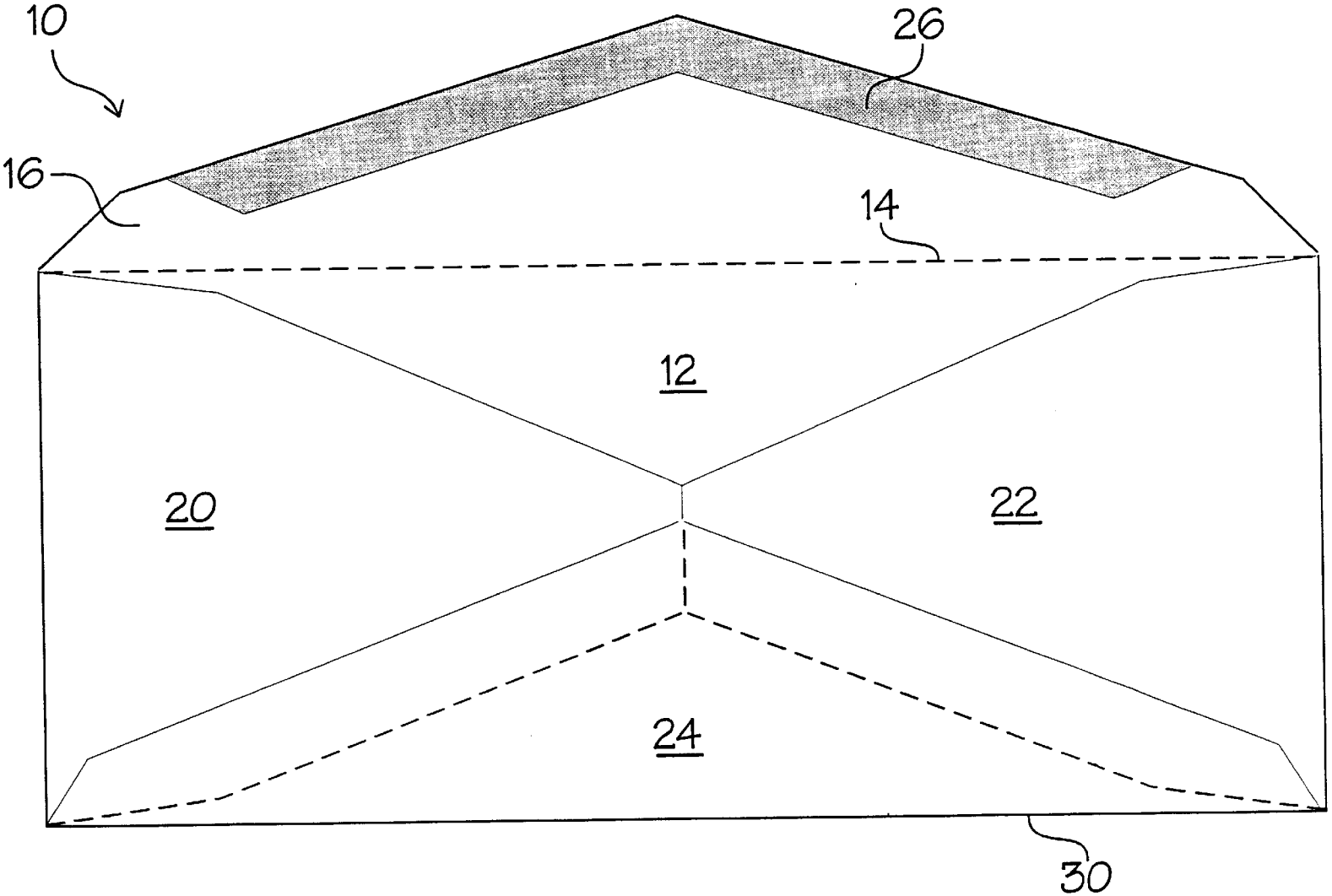
FIG. 5 is a plan view of a folded envelope blank, illustrating the numerous flaps and score lines formed in the blank for folding the blank into an envelope.

Referring to the drawings and particularly to FIG. 5, there is illustrated a folded envelope that is scored and folded from an envelope blank generally designated by the numeral 10 and shown in FIG. 1. A body portion 12 of the envelope blank 10 includes a traverse seal flap score line 14 extending thereacross and forming a top or seal flap 16. The body portion 10 is folded to form a pair of side flaps 20 and 22 which are adhesively secured to a bottom flap 24. The bottom flap 24 is folded into overlying relation with the folded side flaps 20 and 22.

The seal flap 16 has a strip of latex or similar adhesive 26 applied thereto to facilitate final closing of the envelope by the user. The seal flap 16 is folded along score line 14 and secured by the latex adhesive strip 26 in overlying relation with the free end of the bottom flap 24 to provide a self adhesive sealing flap whereon the seal flap 16 may be sealed in the traditional manner.

Now referring to FIG. 1, there is shown a first embodiment of apparatus generally designated by the numeral 27 for separating, aligning, and folding envelope blanks 10 to form the envelope shown in FIG. 5. A group 28 of envelope blanks 10 are fed by a conveyor mechanism (not shown) in the direction indicated by the arrow 29. Although only one such direction is indicated in the figures, it should be understood that the group 28 of envelopes 10 may be fed toward the separating, aligning, and folding apparatus 27 in any suitable direction, including horizontal, angled, and vertical directions.

A leading edge 30, corresponding to the bottom of the folded envelope as shown in FIG. 5, of the leading blank 10 in the feed path partially rests on a backup roller 32 mounted on shaft 34. A segment roller assembly generally designated by the numeral 36 is mounted on a shaft 38 and rotated thereby.

Referring now to FIGS. 6 through 9 there is illustrated an embodiment of the segment roller assembly 36 in which a plurality of different segment rollers are utilized to grip the envelope 10 to separate it from the group of blanks 28. A pair of segment rollers 37 are nonrotatably mounted on the lateral portions of shaft 38. A pair of pull-out segments 40 are attached to corresponding radial portions of the segment rollers 37. Nonrotatably mounted to shaft 38 and centered between the segment rollers 37 is a release roller 39. A crowned release segment 47 is attached to a radial portion of the release roller 39. The radial size (i.e., length) of the release segment is longer than the radial size of the pull-out segment.

As the segment roller assembly 36 rotates in a counterclockwise direction as shown in FIG. 1, at every turn thereof a leading edge 41 (FIG. 7) of each pull-out segment 40 and a leading edge 53 (FIG. 9) of the release segment 47 contact the leading edge 30 of the leading blank 10 in the feed path. The pull-out and release segments 40 and 47 press the blank 10 against the backup roller 32 (FIG. 1) and move the blank onto the surface of an aligner wheel 42.

Figure 10:
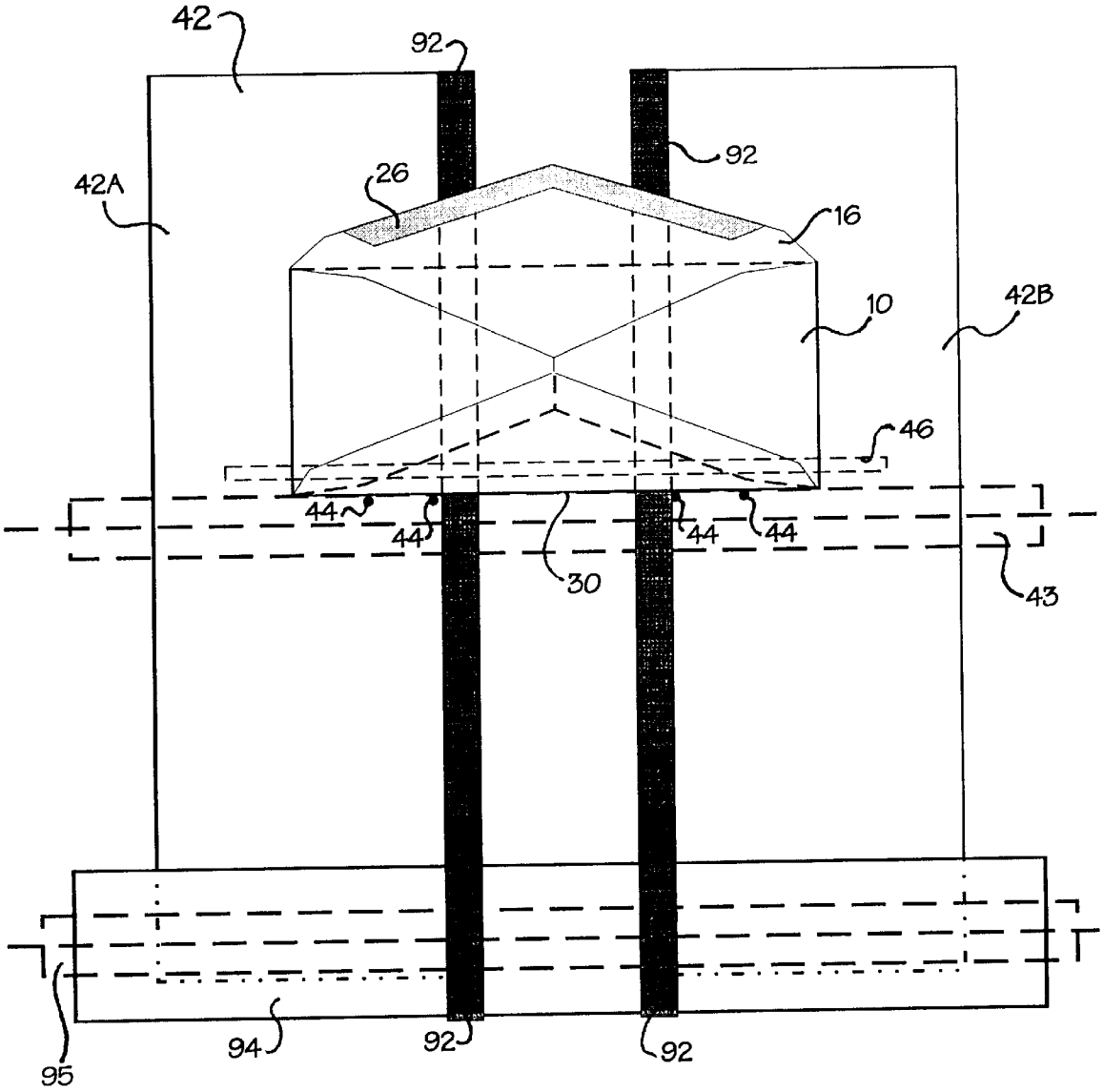
FIG. 10 is a top plan view of an aligner wheel of the envelope machine shown in FIG. 3, illustrating a large size envelope transported on the aligner wheel.

The aligner wheel 42 is nonrotatably mounted on a driven shaft 43 for rotation in a counterclockwise direction. Secured to and extending from the surface of the aligner wheel 42 are a plurality of aligning pins 44. Aligning pins 44 are arranged in spaced relation to receive the leading edge 30 of each blank 10 as it is separated from the overlapping arrangement of blanks 28 by the pull-out and release segments 40 and 47. As illustrated in FIG. 10, the aligning pins 44 are spaced apart across the surface of the aligning wheel 42 to receive the leading edge 30 of blank 10 while the trailing edge of blank 10 remains in contact with pull-out and release segments 40 and 47.

Figure 11:
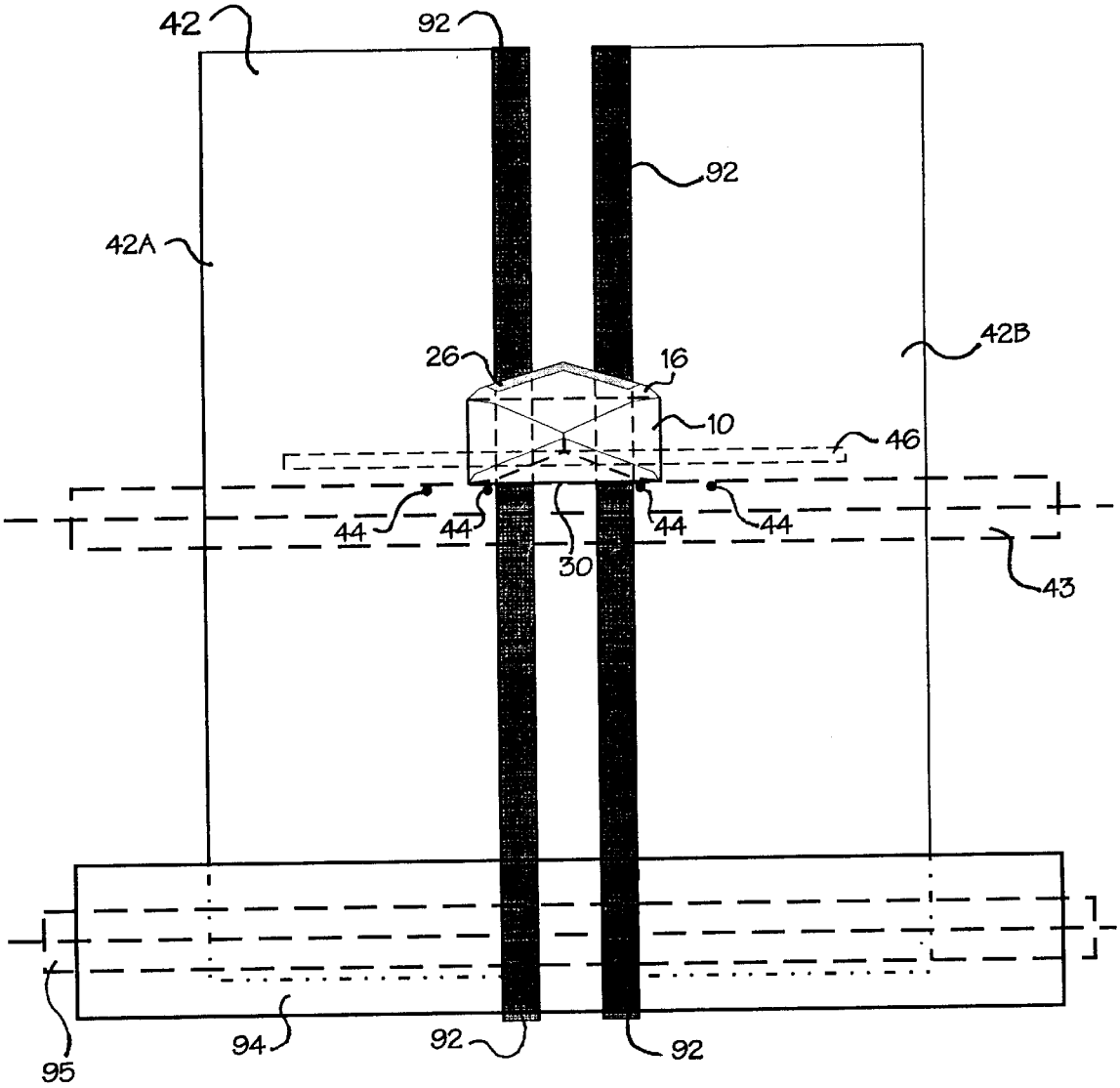
FIG. 11 is a top plan view similar to FIG. 10, illustrating a small size envelope transported on the aligner wheel.

Although a plurality of aligning pins 44 are present on the surface of aligning wheel 42, it should be understood that smaller envelopes, as illustrated in FIG. 11, may be aligned using only two of the pins.

As illustrated in FIGS. 10 and 11, the aligner wheel 42 is made up of a pair of expandable drum sections 42A and 42B. Depending upon the configuration and size of the envelope blanks being processed, the expandable drum sections 42A and 42B may be positioned in contracted or expanded positions relative to each other. For example, for smaller envelope sizes, as shown in FIG. 11, the expandable drum sections 42A and 42B are positioned closer together than shown in FIG. 10, thereby positioning the aligning pins 44 closer to each other. Conversely, for larger size envelopes, as shown in FIG. 10, the drum sections 47 are expanded to move the aligning pins 44 further apart.

Just as the leading edge 30 of envelope blank 10 abuts the aligning pins 44, the pull-out segments 40 rotate out of contact with the trailing edge of blank 10. However, the release segment 47, due to its increased length, remains in contact with the trailing edge of blank 10 for a longer period of time. The crowned nature of the surface of release segment 47 allows the release segment 47 to exert only nominal forward pressure on the blank 10, thereby keeping it aligned on the aligning pins 44 for an extended period of time. The removal of the greater pressure initially exerted by the pull-out segments 40 prevents the blank 10 from being forced into the aligning pins 44 at an increased pressure which could cause damage to the blank.

The aligner wheel 42 rotates at a slower speed than segment roller assembly 36. Therefore, when leading edge 30 contacts or abuts aligner pins 44, proper alignment is obtained. As the pull-out segments 40 release from the blank 10, the release segment 47 continues to exert a forward force on the blank 10, maintaining it in the aligned position. Thus, at one point in the radial feed path, the blank leading edge 30 is forced into contact with the aligner pins 44 as the blank trailing edge remains in contact with the release segment 47 of the roller assembly 36.

Because both ends of the blank are engaged, a buckled portion 45 shown in FIG. 1 is formed in blank 10 immediately adjacent leading edge 30. The buckled portion 45 is forced against the surface of aligner wheel 42 immediately adjacent the aligning pins 44 because the blank 10 is restrained at its leading edge 30 by the pins 44 and its trailing edge by the pull-out segment 40. In this manner, an increased surface area of the envelope blank 10 contacts the surface of the aligner wheel 42 as the blank 10 is initially transferred to the aligner wheel 42 from the overlapping arrangement of blank 10 on the conveyor mechanism.

A vacuum force is applied to the buckled portion 45 of the blank 10 immediately adjacent the leading edge 30 through a pair of vacuum ports 46 located on the surface of aligner wheel 42 closely adjacent to the aligner pins 44. The suction applied through ports 46 maintains the blank 10 in an aligned position on the surface of wheel 42 for conveyance to the folding mechanism.

Although not illustrated in FIG. 1, it should be understood that any number of vacuum ports for generating a reduced pressure on the aligner wheel surface, either primarily or progressively, are used to secure the blank 10 to the aligner wheel 42 throughout its rotation.

A guide member 48 having an arcuate configuration conforming to the outside periphery of the aligner wheel 42 is positioned a preselected distance from the portion of the outer surface of aligner wheel 42 upon which envelope blank 10 travels. The guide member 48 prevents undesired disengagement of the envelope blank 10 from the aligner wheel during transport thereon.

Once secured by suction to the surface of the aligner wheel 42, the blank 10 is conveyed to a folding mechanism generally designated by the numeral 49. The folding mechanism 49 is operable to fold the seal flap 16 into overlying relation with the free end of bottom flap 24 and the side flaps 20 and 22.

The envelope blank 10 is conveyed in a radial feed path by the aligner wheel 42 with the seal flap 26 trailing and the bottom flap 24 leading in the feed path. The envelope 10 passes between the aligner wheel 42 and a folding cylinder 50. Folding cylinder 50 is nonrotatably mounted on a driven shaft 52 which rotates in a clockwise direction. The surface of folding cylinder 50 is provided with a plurality of grooves 51 to allow the aligning pins 44 to pass between the aligner wheel 42 and the folding cylinder 50. The leading edge 30 of envelope blank 10 passes into a trap plate 54 positioned adjacent to the surface of aligner wheel 42 beyond folding cylinder 50. The trap plate 54 includes stops 56 which prevent the leading edge 30 of envelope blank 10 from continuing around aligner wheel 42.

As the leading edge 30 abuts the stops 56 in trap plate 54, the seal flap 16 passes between the aligner wheel 42 and folding cylinder 50. At this point, negative pressure is applied at vacuum ports 58 in folding cylinder 50 to engage the seal flap 16 of envelope blank 10 to the cylinder 50. Simultaneously to the application of negative pressure through vacuum ports 58, the negative pressure applied at vacuum ports 46 is turned off, thereby permitting envelope blank 10 to be released from engagement with aligner wheel 42.

Positioned adjacent and parallel to the folding cylinder 50 is a folder backup roller 60 nonrotatably connected to a driven folder backup shaft 62. The negative pressure applied through vacuum ports 58 onto the blank 10 maintains the seal flap 16 in contact with the rotating folding cylinder 50. As a result, seal flap 16 is pulled into the nip between folding cylinder 50 and folder backup roller 60. Since it is the trailing end of envelope blank 10 which initiates the blank's travel between the folding cylinder 50 and the folder backup roller 60, the blank 10 is forced to fold at a point adjacent to the seal flap 16 to pass between the two cylinders. Pre-formed score line 14 provides a line of weakness in the blank 10 adjacent to the seal flap 16, thereby substantially increasing the likelihood that the seal flap 16 is folded at the proper location.

The folded envelope blank 10 continues to travel in a radial path around folding cylinder 50 with the leading edge being the folded seal flap 16. A vacuum transfer cylinder 64 is nonrotatably connected to a driven shaft 66 for rotation in a counterclockwise direction for receiving the blank 10 from the folding cylinder 50. As the score line 14 of folded envelope 10 enters the nip between folding cylinder 50 and vacuum transfer cylinder 64, negative pressure is progressively applied through vacuum ports 68 on the surface of vacuum transfer cylinder 64 to engage the folded envelope blank 10 to vacuum transfer cylinder 64.

The term "progressive" vacuum refers to the ability to apply and remove reduced pressure to vacuum ports in a sequential manner, thus allowing envelope blanks to be engaged or removed from the cylinder systematically rather than all at once. For example, the envelope blank 10 may be removed beginning at the leading edge, followed by the remaining portion of the blank. Simultaneously to the progressive application of vacuum pressure through ports 68, the negative pressure applied through vacuum ports 58 on cylinder 50 is interrupted so that the envelope 10 is transferred to the vacuum transfer cylinder 64.

Positioned adjacent to the vacuum transfer cylinder 64 is a conventional delivery spiral 70 rotatably driven by a spiral shaft 72 for clockwise rotation. The folded envelope blank 10 is progressively transferred from the vacuum transfer cylinder 64 to the delivery spiral 70 where an envelope is inserted in an arcuate receiving slot 74 for transfer to subsequent operation stations.

Figure 2:
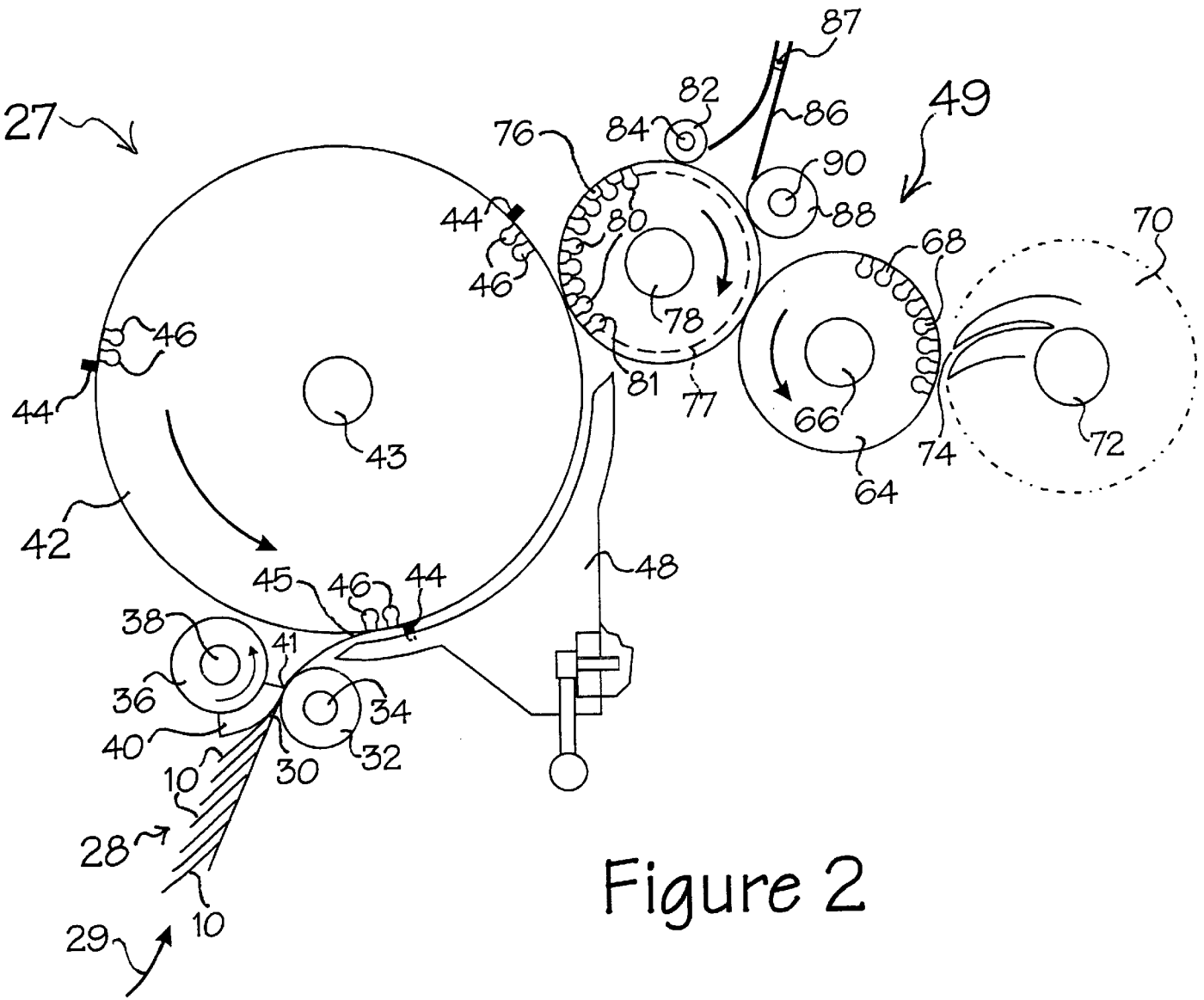
FIG. 2 is a schematic view of a portion of an envelope making machine similar to FIG. 1, illustrating an alternative embodiment for aligning an d folding envelope blanks.

Referring now to FIG. 2, there is illustrated a second embodiment of the aligning and folding mechanism 27 shown in FIG. 1 in which like elements are identified by like numerals shown in FIG. 1. As discussed above with the embodiment illustrated in FIG. 1, each envelope blank 10 is positioned on the aligner wheel 42 with the seal flap 16 trailing and the bottom flap 24 leading in the radial feed path on the surface of the aligner wheel.

A folding cylinder 76 is positioned adjacent to aligner wheel 42 and is nonrotatably mounted on a driven shaft 78 for clockwise rotation therewith. As with folding cylinder 50 shown in FIG. 1, folding cylinder 76 includes a plurality of circumferential grooves 77 aligned with the aligning pins 44 on aligner wheel 42. The grooves 77 permit the aligning pins 44 to pass unhindered between the aligner wheel 42 and the folding cylinder 76.

Folding cylinder 76 includes a plurality of vacuum ports 80 for generating a progressive vacuum pressure on the surface of the cylinder 76 to secure the envelope blank 10, beginning with its leading portion, thereto. Vacuum port 81 on the surface of folding cylinder 76 is positioned relative to vacuum ports 80 to apply negative pressure to the seal flap portion 16 of envelope blank 10.

As the leading edge 30 of envelope blank 10 enters the nip between aligner wheel 42 and folding cylinder 76, subsequent vacuum ports 80 progressively engage the leading edge 30. Simultaneously, the negative pressure applied through vacuum ports 46 on aligner wheel 42 is interrupted, allowing the envelope blank to transfer from aligner wheel 42 to folding cylinder 76. Negative pressure from port 81 is applied to the seal flap 16 as it passes through the nip.

A feed roller 82 is positioned adjacent to folding cylinder 76. The feed roller 82 is nonrotatably mounted on feed shaft 84 for counterclockwise rotation therewith. As the leading edge 30 of envelope blank 10 enters the nip between folding cylinder 76 and the feed roller 82, the negative pressure applied to the envelope blank 10 from ports 80 is progressively removed in time with the blanks passing through the nip.

Rotation of feed roller 82 drives the leading edge 30 of envelope blank 10 into trap 86 located substantially perpendicular to the surface of folding cylinder 76. Trap 86 includes stops 87 positioned to ensure that the forward travel of leading edge 30 is properly halted. Vacuum port 81, on the other hand, maintains a reduced pressure on the seal flap 16 from the folding cylinder 76. Therefore, the seal flap 16 continues to travel around folding cylinder 76 while the remaining envelope portions are positioned in trap 86.

A folder backup roller 88 is nonrotatably mounted on shaft 90 positioned adjacent to folding cylinder 76. Rotation of folding cylinder 76 forces the seal flap 16 into the nip between folding cylinder 76 and folder backup roller 88. In order to follow the seal flap 16 through the nip, the remaining portions of envelope blank 10 are forced to fold over the seal flap 16. Pre-formed score line 14 ensures that the fold takes place in the proper location.

As described above, the folded envelope blank 10 is then transferred by a vacuum transfer cylinder 64 to a conventional delivery spiral 70 for conveyance to subsequent operations.

Figure 3:
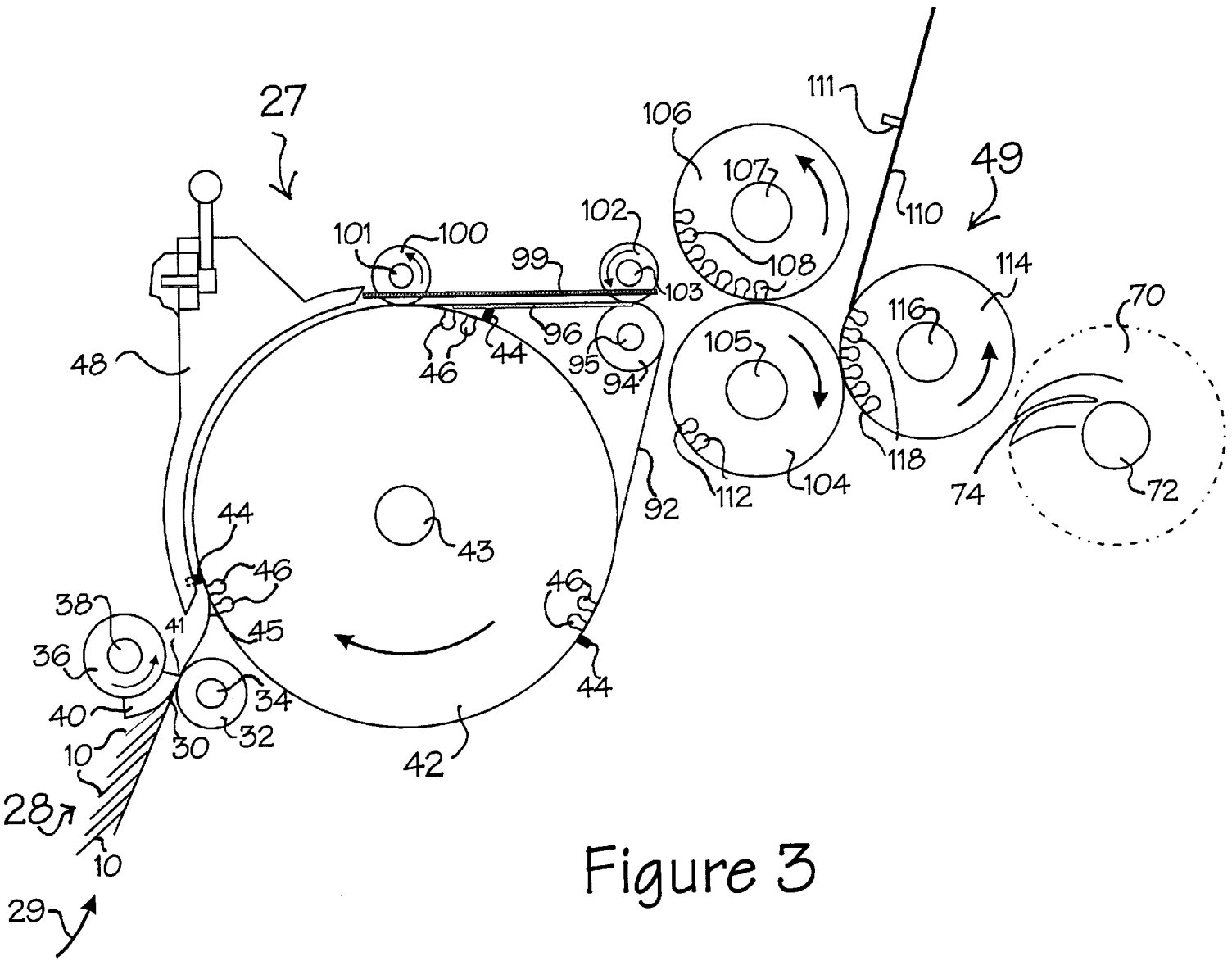
FIG. 3 is a schematic elevational view of a portion of an envelope making machine, illustrating a n additional embodiment in which the blanks are fed clockwise in a radial feed path as the blanks are aligned on the surface of an aligner wheel.

Now referring to FIGS. 3, 10, and 11 there is illustrated a further embodiment of the aligning and folding apparatus 27 in which like elements are also identified by like numerals shown in FIG. 1. Contrary to the embodiments illustrated in FIGS. 1 and 2, the aligner wheel 42 shown in FIG. 3 is rotated in a clockwise direction. Correspondingly, vacuum ports 46 on aligner wheel 42 are positioned behind the aligning pins 44 in the radial feed path in a clockwise direction. Therefore, for the embodiment shown in FIG. 3 the envelope blanks 10 are positioned on the aligner wheel 42 with the bottom flap 24 leading and the seal flap 26 trailing with the adhesive strip 26 exposed on the surface of aligner wheel 42. Also, the guide member 48 is positioned in a different location corresponding to the region of envelope blank travel. Other than these differences, the separating and aligning apparatus shown in FIG. 3 and operation is identical to that described above for the embodiments shown in FIGS. 1 and 2.

A plurality of belts 92, as shown in FIGS. 10 and 11 (one of which is shown in FIG. 3) are positioned in circumferential grooves (not shown) in the surface of aligner wheel 42. The belts 92 are formed of rubber or other similar material to engage and maintain the envelope blank 10 in an aligned position. The belts 92 extend around the surfaces of aligner wheel 42 and a belt roller 94. The belt roller 94 is nonrotatably mounted on driven shaft 95 and is positioned closely adjacent to aligner wheel 42.

As illustrated in FIGS. 10 and 11, belts 92 are movable inboard and outboard with the expandable drum sections 42A and 42B of aligner wheel 42. This permits the belts to be positioned differently for different size envelopes. For larger envelopes, as shown in FIG. 10, the belts are positioned in an outboard or separated position to provide increased lateral support for the envelope. Conversely, with smaller size envelopes, as shown in FIG. 11, the belts are positioned in an inboard or close position to more adequately support the envelope.

The location of belt roller 94 forms the belts 92 into a substantially flat surface extending tangentially from the top of aligner wheel 42. As the envelope blanks 10 reach the point of tangency where belts 92 begin to diverge from the surface of aligner wheel 42, the negative pressure applied from vacuum ports 46 is interrupted, thereby permitting the blanks to be carried by the belts 92. To support the envelope blanks during their transport on the flat portion of belts 92, a support table 96 is positioned in underlying relation to the blanks. The support table 96 has grooves (not shown) through which belts 92 travel.

To maintain the envelope blanks 10 moving forwardly, a pair of rotating feed rollers 100 and 102 are positioned in parallel adjacent relation to the flat portion of belts 92.

Feed rollers 100 and 102 are nonrotatably mounted on shafts 101 and 103, respectively. Feed roller 100 is positioned at the point of tangency to aligner wheel 42. Feed roller 102 is positioned adjacent to and above belt roller 94.

Positioned adjacent to the feed roller 102 and the belt roller 94 is a clockwise rotating folding cylinder 104 and a counterclockwise rotating vacuum lifter cylinder 106 mounted on shafts 105 and 107, respectively. The feed rollers 100 and 102, in combination with the belts 92, feed the envelope blanks 10 into the nip formed between folding cylinder 104 and vacuum lifter cylinder 106.

Vacuum lifter cylinder 106 includes vacuum ports 108 extending longitudinally on the surface thereof. The rotation of vacuum lifter cylinder 106 is so timed as to position the vacuum ports 108 adjacent to the leading edge 30 of envelope blanks 10 as they pass between folding cylinder 104 and vacuum lifter cylinder 106. Negative pressure is progressively applied to the blank leading edge 30 on vacuum lifting cylinder 106. As the envelope blank 10 travels through the nip at cylinder 106, negative pressure is progressively deactivated beginning with the leading edge 30. The free leading edge 30 is then forced by the action of the lifting cylinder 106 into trap 110 located adjacent to vacuum lifter cylinder 106. Trap 110 includes an adjustable stop 111 for abutting the leading edge 30 of the envelope blank 10 and halting the blank's forward progress. At this point, the negative pressure is completely removed from the surface of cylinder 106.

Folding cylinder 104 includes a plurality of vacuum ports 112 located on the periphery thereof. Rotation of folding cylinder 104 is so timed that, as the envelope 10 passes between folding cylinder 104 and vacuum lifter cylinder 106, vacuum ports 112 apply negative pressure to the seal flap 16, thereby engaging it to folding cylinder 104.

A counterclockwise rotating folder backup and transfer cylinder 114 is nonrotatably mounted on shaft 116 and positioned adjacent to folding cylinder 104. Rotation of folding cylinder 104 forces the seal flap 16 into the nip between folding cylinder 104 and folder backup and transfer roller 114. In order to follow the seal flap 16 through the nip, the remaining portion of the envelope blank 10 is forced to fold over the seal flap 16. Pre-formed score line 14 ensures that the fold takes place in the proper location.

Vacuum ports 118 located on the periphery of backup and transfer cylinder 114 progressively engage the folded envelope blank 10 following its passage between the folding cylinder 104 and the backup and transfer cylinder 114. Simultaneously, the vacuum pressure applied through vacuum ports 112 is interrupted, thereby permitting the envelope blank 10 to be fed from the folding cylinder 104 to the backup and transfer cylinder 114. As described above, each folded envelope blank 10 is then delivered into a slot 74 of the delivery spiral 70 for conveyance to subsequent operations.

Figure 4:
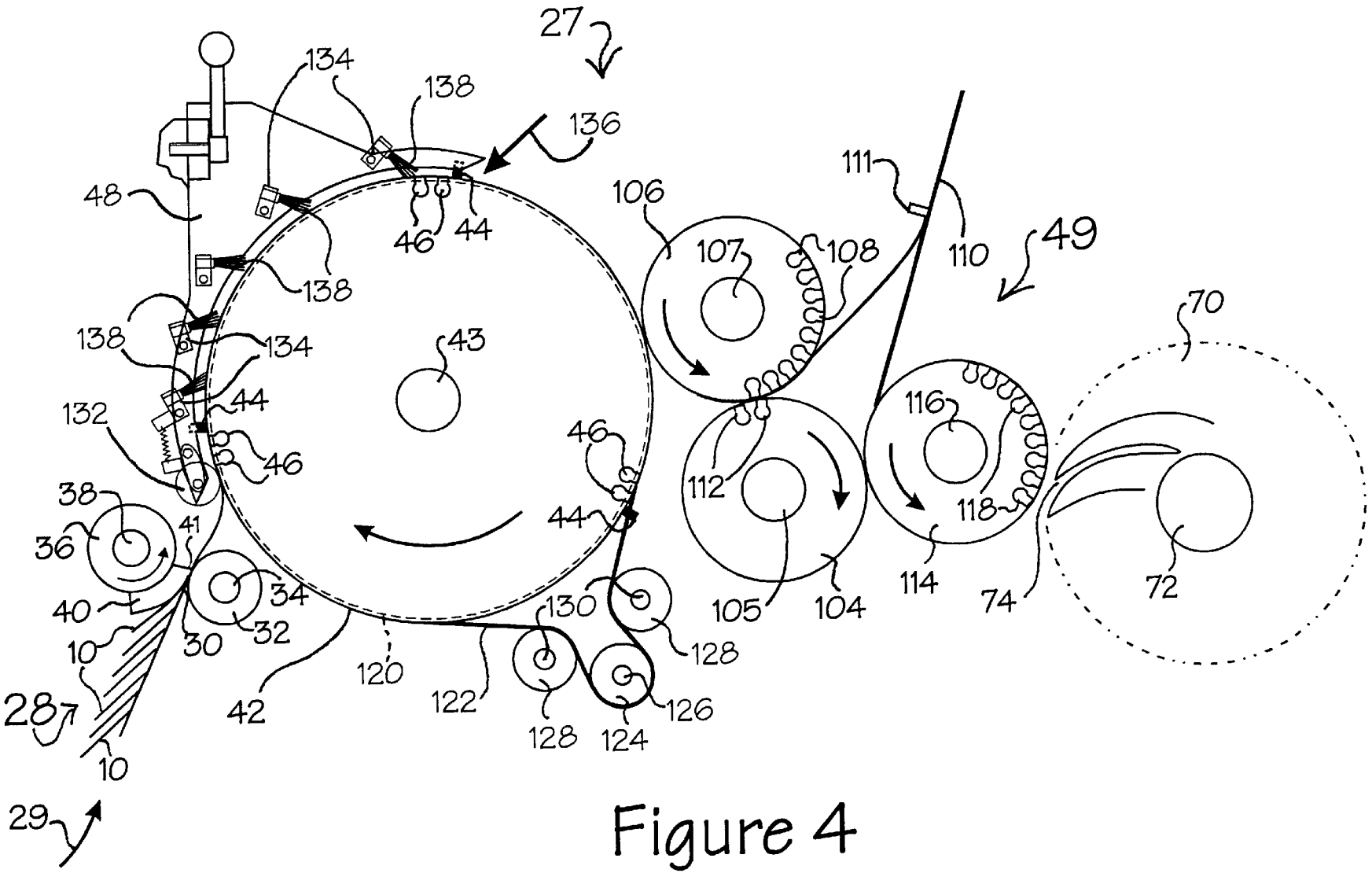
FIG. 4 is a schematic elevational view of a portion of an envelope making machine, illustrating a further embodiment of the present invention in which the blanks are incrementally aligned on the surface of the aligner wheel.

Now referring to FIG. 4, there is illustrated an additional embodiment of the aligning and folding apparatus 27 of the present invention in which like elements are also identified by like numerals shown in FIG. 3. Aligner wheel 42 includes a plurality of belt pulleys 120 (one of which is illustrated in phantom in FIG. 4) rotatably mounted on aligner shaft 43 between expandable drum sections 42A and 42B. A plurality of belts 122 are reeved at one end about belt pulleys 120 and at another end about a belt drive roller 124 nonrotatably mounted on driven shaft 126. The belts 122 are so positioned on pulleys 120 as to extend slightly beyond the outer periphery of the aligner wheel 42. Suitable drive means rotate belts 122 at a speed slightly greater than the speed of the aligner wheel 42. A pair of belt drive tensioning rollers 128 are nonrotatably mounted on adjustable shafts 130 for providing any necessary tensioning force on belts 122.

As described above, envelope blanks 10 are separated by from a group of overlapping blanks 28 by segment roller assembly 36 and forced into abutment with the aligner wheel 42.

Unlike the embodiments illustrated in FIGS. 1–3 and discussed above, vacuum pressure is not applied through vacuum ports immediately upon formation of buckled portion 45. Rather, as shown in FIG. 4, the guide member 48 includes an entry roller 132 rotatably mounted thereto. Entry roller 132 is positioned at the point of initial contact between envelope blank 10 and aligner wheel 42 and forces the leading edge 30 of envelope blank 10 into contact with the belts 122.

Also unlike the previous embodiments discussed above, the leading edge 30 of envelope blank 10 is not forced into initial abutting relation with the aligning pins 44. Rather, as shown in FIG. 4, the blank 10 engages the aligning wheel 42 at a position spaced behind the aligning pins 44. As the belts 122 rotate, the envelope blank 10 is carried thereon between guide member 48 and belts 122. Because belts 122 are travelling at a slightly greater speed than aligning pins 44, travel of the envelope blank 10 upon the belts 122 incrementally advances the leading edge 30 of the envelope blank 10 toward the aligning pins 44 during the blank's rotation. This advancing action forces the leading edge 30 against the aligning pins 44 and into alignment. To ensure that the envelope blank 10 does not become disengaged from the belts 122 during incremental alignment, a series of tensioning devices 134 are mounted on the guide member 48 to exert a preselected force against the envelope blank 10 thereby maintaining the blank's engagement with belts 122.

As shown in FIG. 4, the tensioning devices 134 in one embodiment include a plurality of adjustably positioned brushes 138. Each brush 138 is individually positioned to ensure that the proper amount of pressure is exerted on the envelope blank 10. It should be understood that alternative tensioning devices are contemplated in accordance with the present invention and include rollers and the like.

Following the incremental alignment of envelope blank 10, negative pressure is exerted through vacuum ports 46 at the position indicated by arrow 136 to maintain the envelope blank in an aligned state throughout the subsequent transfer of envelope blank 10. In the manner described above, envelope blank is transferred to the folding assembly 49 including vacuum lifter cylinder 106, trap 110, folding cylinder 104, backup and transfer cylinder 114, and delivery spiral 70, as shown in FIG. 3.

According to the provisions of the patent statutes, we have explained the principle, preferred construction, and mode of operation of our invention and have illustrated and described what we now consider to represent its best embodiments. However, it should be understood that, within the scope of the appended claims, the invention may be practiced otherwise than as specifically illustrated and described.

We claim:

1. Apparatus for separating and aligning overlapped blanks of sheet material comprising, conveying means supported in a frame member for moving a plurality of overlapped blanks in a feed path at a preselected speed, a feed cylinder rotatably supported in the feed path adjacent to said conveying means, said feed cylinder including a pull-out segment, said feed cylinder rotatable at a speed greater than the speed of said conveying means to separate the overlapped blanks into spaced relation, a back-up roller rotatably supported oppositely of said pull-out segment forming a bight therebetween, drive means for rotating said feed cylinder to advance a first blank in the feed path from said conveying means into said bight between said pull-out segment and said back-up roller to separate the first blank from the remaining overlapped blanks, an aligner wheel rotatably supported adjacent to said feed cylinder for receiving the first separated blank from the remaining overlapped blanks, said aligner wheel rotating at a speed slower than said speed of said feed cylinder, said aligner wheel having a plurality of aligning pins extending from the surface thereof, said aligning pins receiving in abutting relation a leading edge of the first separated blank while a trailing edge of the blank remains in contact with said pull-out segment to align the blank on the surface of said aligner wheel, vacuum means mounted on said aligner wheel for engaging separated blanks on the surface of said aligner wheel, said vacuum means positioned adjacent to said aligning pins to engage the leading edge of the first blank as the blank is separated from the remaining overlapped blanks, and said pull-out segment exerting forward pressure on the first blank as the leading edge thereof is moved into contact with the aligning pins to positively position the blank on the surface of the aligner wheel for increased engagement of the blank by said vacuum means on the surface of said aligner wheel.

2. Apparatus as set forth in claim 1 in which, said feed cylinder includes two outer pull-out segments and an inner pull-out segment each having a preselected radial size, and said inner pull-out segment having a longer radial size than the radial size of said outer pull-out segments for exerting a force on the first separated blank for a longer duration than the force exerted by said outer pull-out segments.

3. Apparatus as set forth in claim 2 in which, said inner pull-out segment has a crowned outer surface for decreasing the force exerted by the inner pull-out segment on the first separated blank.

4. Apparatus for aligning and folding a blank of sheet material comprising, an aligner wheel rotatably mounted in a frame member, first drive means for rotating said aligner hweel in a preselected direction at a preselected speed, said aligner wheel including a plurality of aligner pins extending from the surface thereof, means for advancing a leading end of a blank having a preformed score line at a trailing end thereof into abutting relation with said aligner pins, said means for advancing feeding the blank at a speed greater than the speed of said aligner wheel so that forward pressure is exerted at the blank trailing end as the leading end of the blank contacts the aligner pins on the surface of said aligner wheel, said aligner wheel including vacuum means positioned on the surface of said aligner wheel for engaging immediately adjacent said aligner pins the portion of the blank in contact with said aligner wheel to secure the blank to the surface of said aligner wheel in preselected alignment thereon, second drive means for rotating said aligner wheel to advance the blank in a radial feed path, and means positioned adjacent to said aligner wheel for receiving the blank conveyed in the radial feed path and folding the blank at said preformed score line.

5. Apparatus as set forth in claim 4 in which, said means for advancing the blank includes a conveyor mechanism supported in said frame member for advancing a group of overlapped blanks at a preselected speed, a feed cylinder rotatably supported in said frame member adjacent to said conveyor mechanism, said feed cylinder including a pull-out segment assembly positioned radially thereon, said feed cylinder rotatable at a speed greater than the preselected speed of said conveying means to separate the overlapped blanks into spaced relation, a back-up roller rotatably supported oppositely of said pull-out segment assembly forming a bight therebetween, drive means for rotating said feed cylinder to advance the blank having a preformed score line from said conveying means into said bight between said pull-out segment assembly to separate the blank from the remaining overlapped blanks and into abutting relation with said aligning pins.

6. The apparatus set forth in claim 5 in which, said pull-out segment assembly includes two outer pull-out segments and an inner pull-out segment each having a preselected radial size, said inner pull-out segment having a longer radial size than the radial size of said outer pull-out segments for exerting a force on the first separated blank for a longer duration than the force exerted by said outer pull-out segments, and said inner pull-out segment having a crowned outer surface for reducing the force exerted by the inner pull-out segment on the first separated blank.

7. Apparatus as set forth in claim 4 in which, said receiving and folding means includes a trap plate having stops therein positioned adjacent to said aligner wheel for stopping the conveyance of said blank about said aligner wheel, a seal flap folding cylinder positioned parallel and adjacent to said aligner wheel forming a bight therebetween, drive means for rotating said seal flap folding cylinder in a second direction opposite to said preselected direction of said aligner wheel, said seal flap folding cylinder including vacuum means mounted thereon for engaging the blank trailing end behind said preformed score line as the blank travels on said aligner wheel and into said trap, said aligner wheel vacuum means disengaging the blank upon engagement of the blank trailing end by said seal flap folding cylinder vacuum means, and a folder back-up roller supported oppositely of said seal flap folding cylinder forming a bight therebetween for folding the blank upon said preformed score line as the blank travels into said bight between said folder back-up roller and said seal flap folding cylinder.

8. Apparatus as set forth in claim 4 in which, said receiving and folding means includes a seal flap folding cylinder positioned in close parallel relation to said aligner wheel forming a bight therebetween, drive means for rotating said seal flap folding cylinder in a second direction opposite to said preselected direction of said aligner wheel, said seal flap folding cylinder including vacuum means mounted thereon for engaging the blank as the blank travels about said aligner wheel, said seal flap folding cylinder vacuum means including a progressive vacuum portion engaging a portion of the blank preceding said preformed score line and a primary vacuum portion engaging the blank trailing end following said preformed score line, said aligner wheel vacuum means disengaging the blank upon engagement of the blank by said seal flap folding cylinder vacuum means, a feed roller positioned in close parallel relation to said seal flap folding cylinder forming a bight therebetween, drive means for rotating said feed cylinder in said preselected direction opposite said second direction of said seal flap folding cylinder, said progressive vacuum portion of said seal flap folding cylinder vacuum means progressively disenging the portion of the blank preceding said preformed score line from said seal flap folding cylinder at a position adjacent said feed roller, a trap positioned adjacent said feed roller for receiving the portion of the blank preceding said preformed score line as it is released from said seal flap folding cylinder vacuum means, a folder back-up roller positioned in close parallel relation to said seal flap folding cylinder forming a bight therebetween, and said bight between said folder back-up roller and said seal flap folding cylinder receiving the blank beginning with the preformed score line thereby folding said portion of the blank preceding said preformed score line over the trailing end about said preformed score line.

9. Apparatus as set forth in claim 4 including, at least one feed belt positioned in overlying fixed relation to said aligner wheel in spaced relation with said aligner wheel vacuum means, said belt extending around a belt roller positioned in spaced parallel relation to said aligner wheel forming a linear travel segment for conveying the blank to said receiving and folding means, at least one feed roller positioned in close parallel relation to said linear travel segment to urge the blank along said linear travel segment, a vacuum lifter cylinder positioned in spaced parallel relation to said belt roller, said vacuum lifter cylinder including vacuum means mounted thereon for engaging a leading edge of the blank as the blank travels on said belt adjacent said belt roller, a seal flap folding cylinder supported oppositely of said vacuum lifter cylinder forming a bight therebetween, said seal flap folding cylinder including vacuum means mounted thereon for engaging the trailing edge of the blank following said preformed score line, drive means for rotating said seal flap folding cylinder in said preselected direction and said vacuum lifter cylinder in a direction opposite said preselected direction of seal flap folding cylinder, a backup and transfer cylinder supported oppositely of said seal flap folding cylinder forming a bight therebetween, said vacuum lifter cylinder vacuum means operable to engage the leading edge of the blank and force the leading edge of the blank into a trap positioned adjacent said vacuum lifter cylinder, and said flap folding cylinder vacuum means operable to engage the trailing end of the blank and direct the trailing end of the blank into the bight between said backup and transfer cylinder and said seal flap folding cylinder thereby folding said blank about said preformed score line.

10. A method for aligning and folding blanks of sheet material including the steps of, feeding a plurality of blanks in overlapping relation with a first blank having a leading edge and a trailing edge, feeding the leading edge of the first blank into a nip formed between a rotating pull-out roller and a backup roller, rotating the pull-out roller at a preselected speed to advance the first blank out of overlapping relation with the remaining blanks, positioning a rotatable aligning wheel adjacent to the backup roller, positioning a plurality of aligning pins on the surface of the aligning wheel, positioning a plurality of vacuum ports on the surface of the aligning wheel for generating negative pressure on the surface of the aligning wheel adjacent to the aligning pins, rotating the aligning wheel in a preselected rotational direction at a preselected speed slower than the rotational speed of the pull-out roller, feeding the first blank onto the surface of the aligning wheel by the pull-out roller exerting forward pressure on the trailing edge of the first blank, abutting the leading edge of the first blank with the aligning pins as the pull-out roller continues to exert forward pressure on the trailing edge of the first blank to move the first blank into a preselected position on the surface of the aligning wheel, moving the first blank upon contact with the aligning pins into contact with the surface of the aligning wheel, securing the portion of the first blank in contact with the surface of the aligning wheel by the negative pressure from the vacuum ports to the surface of the aligning wheel, rotating the aligning wheel to feed the first blank in a radial feed path, removing the first blank from the surface of the aligning wheel, and folding the first blank in a feed path removed from the aligning wheel.

11. A method as set forth in claim 10 which includes, providing the rotating pull-out roller with a pair of outer pull-out segments and an inner pull-out segment having an outer surface, each pull-out segment having a preselected radial size, extending the inner pull-out segment in a longer radial size than the outer pull-out segments for exerting a force on the leading edge of the first blank for a longer duration than the force exerted by the outer pull-out segments, and crowning the outer surface of the inner pull-out segment for reducing the force exerted on the leading edge of the first blank by the inner pull-out segment.

12. A method as set forth in claim 10 which includes, positioning a trap plate having stops therein adjacent to the aligner wheel for stopping the conveyance of the first blank about said aligning wheel, mounting a seal flap folding cylinder in parallel and adjacent relation to the aligning wheel forming a bight therebetween, rotating the seal flap folding cylinder in a preselected direction opposite the preselected rotational direction of said aligning wheel, mounting vacuum means on the seal flap folding cylinder for engaging a blank trailing end behind a preformed score line as the blank travels on the aligning wheel, disengaging the blank from the aligning wheel vacuum ports upon engagement of the blank trailing end by the seal flap folding cylinder vacuum means to remove the blank from the aligning wheel starting with the blank preformed score line, supporting a folder back-up roller oppositely of the seal flap folding cylinder forming a bight therebetween, and folding the blank upon the preformed score line as the blank travels into the bight between the folder back-up roller and the seal flap folding cylinder.

13. A method as set forth in claim 10 which includes, positioning a seal flap folding cylinder in close parallel relation to the aligning wheel forming a bight therebetween, rotating the seal flap folding cylinder in a preselected direction opposite the preselected rotational direction of the aligning wheel, mounting vacuum means on the seal flap folding cylinder for engaging the blank as the blank travels about the aligning wheel, providing the seal flap folding cylinder vacuum means with a progressive vacuum portion for engaging a portion of the blank preceding a preformed score line and a primary vacuum portion for engaging a trailing end of the blank following the preformed score line, disengaging the blank from the aligning wheel vacuum ports upon engagement of the blank by the seal flap folding cylinder vacuum means, supporting a feed roller in close parallel relation to the seal flap folding cylinder forming a bight therebetween, rotating the feed cylinder in the preselected rotational direction of the aligning wheel, disengaging the portion of the blank preceding the preformed score line from the seal flap folding cylinder vacuum means at a position adjacent the feed roller, positioning a trap adjacent the feed roller for receiving the portion of the blank preceding the preformed score line as it is released from the seal flap folding cylinder, supporting a folder back-up roller in close parallel relation to the seal flap folding cylinder forming a bight therebetween, and feeding the blank beginning with the preformed score line into the bight between the folder back-up roller and the seal flap folding cylinder thereby folding the portion of the blank preceding the preformed score line over the trailing end about the preformed score line.

14. A method as set forth in claim 10 which includes, positioning at least one feed belt in overlying fixed relation to the aligning wheel in spaced relation to the aligning wheel vacuum ports, extending the belt around a belt roller positioned in spaced parallel relation to the aligning wheel forming a linear travel segment for conveying the blank away from the aligning wheel, positioning at least one feed roller in close parallel relation to the linear travel segment to urge the blank along the linear travel segment, supporting a vacuum lifter cylinder in spaced parallel relation to the belt roller, mounting vacuum means on the vacuum lifter cylinder for engaging the leading edge of the blank as the blank travels on the belt adjacent the belt roller, supporting a seal flap folding cylinder oppositely of the vacuum lifter cylinder forming a bight therebetween, mounting vacuum means on the seal flap folding cylinder for engaging a trailing edge of the blank following a preformed score line, rotating the seal flap folding cylinder in the preselected rotational direction of the aligning wheel, rotating the vacuum lifter cylinder in a direction opposite the preselected rotational direction of the aligning wheel, disengaging the leading edge of the blank from the vacuum lifter cylinder and forcing the leading edge into a trap positioned adjacent the vacuum lifter cylinder, positioning a backup and transfer cylinder in close parallel relation to the seal flap folding cylinder forming a bight therebetween, directing the preformed score line into the bight between the seal flap folding cylinder and the backup and transfer cylinder, and folding the blank about the preformed score line.

15. Apparatus for separating and aligning overlapped blanks of sheet material comprising, conveying means supported in a frame member for moving a plurality of overlapped blanks in a feed path at a preselected speed, a feed cylinder rotatably supported in the feed path adjacent to said conveying means, said feed cylinder including a pull-out segment, said feed cylinder rotatable at a speed greater than the speed of said conveying means to separate the overlapped blanks into spaced relation, a back-up roller rotatably supported oppositely of said pull-out segment forming a bight therebetween, drive means for rotating said feed cylinder to advance a leading edge of a first blank in the feed path from said conveying means into said bight between said pull-out segment and said back-up roller as said feed cylinder exerts a forward force on a trailing edge of the first blank to separate said first blank from the remaining overlapped blanks, an aligner wheel rotatably supported adjacent to said feed cylinder for receiving the first separated blank from the remaining overlapped blanks, said aligner wheel rotating in a preselected direction at a speed slower than said speed of said feed cylinder, a plurality of belts having outer surfaces reeved about said aligner wheel and rotating in said preselected direction at a speed slightly faster than said speed of said aligner wheel, said outer surfaces of said belts extending slightly beyond the surface of said aligner wheel, said aligner wheel having a plurality of aligning pins extending from the surface thereof beyond the outer surfaces of said belts, said aligning pins receiving in abutting relation the leading edge of the first separated blank as the forward force is exerted on the blank trailing edge to align the blank on the surface of said aligner wheel, said first separated blank being conveyed along said belts as said feed cylinder continues to exert a forward force on the first blank trailing edge and the first blank leading edge being urged against said slower moving aligning pins into an aligned position on said aligner wheel, vacuum means mounted on said aligner wheel for engaging separated blanks on the surface of said aligner wheel, and said vacuum means positioned adjacent to said aligning pins to engage a portion of the first blank after the blank is aligned against said aligning pins for increased engagement of the blank on the surface of said aligner wheel.

16. A pparatus as set forth in claim 15 which includes, said feed cylinder including a pair of outer pull-out segments and an inner pull-out segment, each pull-out segment being radially mounted thereon and having a preselected radial size, said inner pull-out segment having a longer radial size than the radial size of said outer pull-out segments for applying a pulling force on the first blank of longer duration than the pulling force applied by said outer pull-out segments, and said inner pull-out segment having a crowned outer surface for decreasing the force applied by the inner pull-out segment on the first blank.

17. Apparatus as set forth in claim 15 which includes, an arcuate guide member supported in spaced concentric relation to said aligner wheel, said guide member having a plurality of tensioning devices projecting therefrom toward said aligner wheel, said tensioning devices operable to exert a force on the first blank toward said outer surfaces of said belts to maintain the first blank in contact with said outer surfaces of said belts, and said aligner wheel vacuum means being activated to engage the first blank to the aligner wheel following passage of the first blank through said arcuate guide between said tensioning devices and said belts.

18. Apparatus as set forth in claim 17 in which, said tensioning devices include brushes fixedly depending from said arcuate guide member.

19. Apparatus as set forth in claim 17 in which, said tensioning devices include rollers rotatably mounted on said guide member.

20. Apparatus as set forth in claim 16 which includes, a folding mechanism including a vacuum lifter cylinder, a trap, a folding cylinder, and a backup and transfer cylinder for folding the first blank at a preformed score line, said vacuum lifter cylinder being positioned in spaced parallel relation to said aligner wheel, said vacuum lifter cylinder including vacuum means mounted thereon for engaging a leading edge of the blank as the blank travels on said aligner wheel, said folding cylinder being supported oppositely of said vacuum lifter cylinder forming a bight therebetween, said folding cylinder including vacuum means mounted thereon for engaging a trailing edge of the blank following the preformed score line, drive means for rotating said vacuum lifter cylinder in a direction opposite the preselected direction of said aligner wheel and for rotating said folding cylinder in the preselected direction of said aligner wheel, said backup and transfer cylinder being supported oppositely of said folding cylinder forming a bight therebetween, said vacuum lifter cylinder vacuum means being operable to engage the leading edge of the blank and force the leading edge of the blank into said trap positioned adjacent said vacuum lifter cylinder, and said folding cylinder vacuum means being operable to engage the trailing end of the blank and direct the preformed score line of the blank between said folding cylinder and said backup and transfer cylinder thereby folding said blank about said preformed score line.

* * * * *